US005345886A

United States Patent [19]

Eichhorn

[11] Patent Number: 5,345,886

[45] Date of Patent: Sep. 13, 1994

[54] ARRANGEMENT FOR AND METHOD OF PRODUCING PANTYHOSES

[76] Inventor: Rudolf Eichhorn, Eberstalerstr. 17, 7109 Altkrautheim, Fed. Rep. of Germany

[21] Appl. No.: 14,383

[22] Filed: Feb. 5, 1993

[30] Foreign Application Priority Data

Feb. 6, 1992 [DE] Fed. Rep. of Germany ..... 4203383

[51] Int. Cl.[5] ..... D05B 21/00

[52] U.S. Cl. ..... 112/121.15; 112/262.2

[58] Field of Search ..... 112/121.15, 262.1, 262.2, 112/272.3, 63

[56] References Cited

U.S. PATENT DOCUMENTS

| | | | |
|---|---|---|---|
| 4,188,898 | 2/1980 | Bell, Jr. et al. | 112/121.15 X |
| 4,359,956 | 11/1982 | Sakonishi | 112/121.15 X |
| 4,558,653 | 12/1985 | Horton et al. | 112/121.15 X |
| 5,058,516 | 10/1991 | Maegawa et al. | 112/121.15 X |

FOREIGN PATENT DOCUMENTS

| | | | |
|---|---|---|---|
| 166594 | 1/1986 | European Pat. Off. | 112/121.15 |
| 1956684 | 6/1970 | Fed. Rep. of Germany . | |
| 7120700 | 9/1971 | Fed. Rep. of Germany | 112/121.15 |
| 2156949 | 6/1972 | Fed. Rep. of Germany . | |
| 3228073 | 2/1983 | Fed. Rep. of Germany . | |
| 3911856 | 10/1989 | Fed. Rep. of Germany . | |
| 4036989 | 6/1991 | Fed. Rep. of Germany . | |

*Primary Examiner*—Clifford D. Crowder
*Assistant Examiner*—Paul C. Lewis
*Attorney, Agent, or Firm*—Michael J. Striker

[57] ABSTRACT

An arrangement for producing a pantyhose from prefabricated hose-shaped individual parts has at least one template movable in working stations and composed of two tensioning arms for pulling corresponding prefabricated pantyhose parts of a pantyhose, the tensioning arms being movable parallel to one another and arranged on supporting arms, a cutting device defining a cutting plate, the supporting arms being mirror-symmetrical relative to the cutting plane of the cutting device, the supporting arms of the template being immovable relative to one another, bent in a plane of the tensioning arms in a U-shaped manner, and provided with driveable endless transporting belts.

11 Claims, 8 Drawing Sheets

ARRANGEMENT FOR AND METHOD OF PRODUCING PANTYHOSES

BACKGROUND OF THE INVENTION

The present invention relates to an arrangement for and method of producing pantyhoses from prefabricated hose shaped individual parts.

In particular, it relates to such an arrangement and method in accordance with which the arrangement has at least one template movable in a working station and provided with two tensioning arms for pulling correspondingly a prefabricated pantyhose part of a pantyhose, wherein the tensioning arms are composed of two supporting arms arranged mirror-symmetrically to a common cutting plane of a cutting device.

An arrangement of the above mentioned general type is disclosed, for example in the U.S. Pat. No. 4,188,898. The templates used in this arrangement after cutting of both hose shaped pantyhose parts the supporting arms of the tensioning frames are turned outwardly to release the formed cutting edges of both pantyhose parts for sewing. The turning out of the supporting arms of a tensioning frame has the disadvantage that the pulled pantyhose part is strongly expanded in its non-cut region and must be produced in a corresponding loose knitting way so as to overlap this strong expansion without damages. A further disadvantage of the known templates is that not only required sizes of pantyhoses can be pulled on them, but instead several template sizes must be available.

SUMMARY OF THE INVENTION

Accordingly, it is an object of the present invention to provide an arrangement for and a method of producing pantyhoses, which avoid the disadvantages of the prior art.

More particularly, it is an object of the present invention to provide an arrangement for and a method of producing pantyhoses in accordance with which with uniform templates or required sizes of pantyhoses, from children pantyhoses to pantyhoses with oversizes, can be produced without strong expansion load of the individual pantyhose parts during the pantyhose manufacturing process.

In keeping with these objects and with others which will become apparent hereinafter, one feature of the present invention resides, briefly stated, in an arrangement for producing pantyhoses in which the supporting arms of the template are formed immovably relative to one another, bent in the plane of the tensioning frame in a U-shaped manner, and provided with driveable endless transporting belts.

With the use of the templates formed in accordance with the present invention in the arrangement, the pantyhose parts can be knitted with saving of textile material in their collar region firmer, since in the template no over-expansion of the collar region can occur. With the templates it is possible to arbitrarily adjust the length of the body parts of the pantyhose and to correspondingly widely separate the pantyhose parts, since on the bent end regions of the supporting arms sufficient place for each body part length is provided for the formed edge for subsequent sewing up of the edges.

The endless transported belts can extend in the guiding paths of the supporting arms partially outwardly and partially can be arranged with a driver edge freely moving relative to sliding surfaces which are oriented between and parallel to both tensioning frames of a template. Advantageously, each supporting arm has also at least one lifting bar which extends freely on the outwardly located side of the corresponding tensioning frame from the U-shaped end of the supporting arm until the region of U-curvature of the supporting arm. There, for facilitating of the release of the formed cutting edges the arm cut halves of the pantyhose parts are lifted from the supporting arms by the lifting bar.

At the end of the U-shaped part of the supporting arms the supporting arms of both tensioning frames can be anchored in a common holder. In this region the drive of the transporting belt can be performed by means of a drive roller. Advantageously, each transporting band is associated with its own stepper motor. Thereby, with the template formed in accordance with the present invention, an accurate opposite-side orientation of both pantyhose parts with one another after their cutting can be provided. Also, the stepper motors ensure the adjustment of transporting movements to a desired length of the body part via a common control device in a relatively simple manner. The common holder for the supporting arms can be arranged on a movable part of the arrangement rotatably and for example displaceably over a curved path. Therefore, the templates can be moved relative to a stationary sewing device so that for each hose size a sewing up of the formed cutting edges can be performed over their hole length.

A reliable engagement of the pantyhose parts during pulling on the supporting arms of the template can be provided in that the transporting belts have on their driver edge a driver lip which is narrowing, toothed and contacts the sliding surfaces. A reliable fixation of the pantyhose parts on the supporting arms in the desired position and during predetermined working times can be obtained by electromagnetically actuated clamping element whose movable clamping plate cooperates with a sliding surface as a counter-clamping surface during interpositioning of the pantyhose material.

For forming a pantyhose from two prefabricated hose-shaped pantyhose parts in accordance with the inventive method the following steps are performed:

- placing one pantyhose part on the cutting plane-adjacent ends of the supporting arm pair of the first tensioning frame and pulling step-by-step over a predetermined orientation position by the transporting belts of the supporting arms;
- repeating the preceding step on the second tensioning frame and pulling the second pantyhose part with orientation of the initial portion of the pantyhose part to the initial portion of the first pantyhose part;
- moving the template and/or the cutting device until the cutting device is located in the cutting plane between the U-shaped arc of the four supporting arms of the template;
- transporting both pantyhose parts by synchronously driving of all transporting bands through the region of the cutting device with a separation of both pantyhose part hoses at the opposite locations of both tensioning frames. Simultaneously lifting both pantyhose parts in their uncut region by the lifting bars at the opposite sides of both tensioning frames;
- moving the formed cutting edges by means of the transporting bands over the U-curvature in the outer legs of the supporting arms over a desired length;

paired sewing up the freely located both pantyhose parts with bending of the wound cutting edges, in at least one sewing station;

back transportation of the sewn up pantyhose parts of the pantyhose from the outer supporting arm legs by direction reverse of the transporting belt drive and removal of the finished pantyhose from the template.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
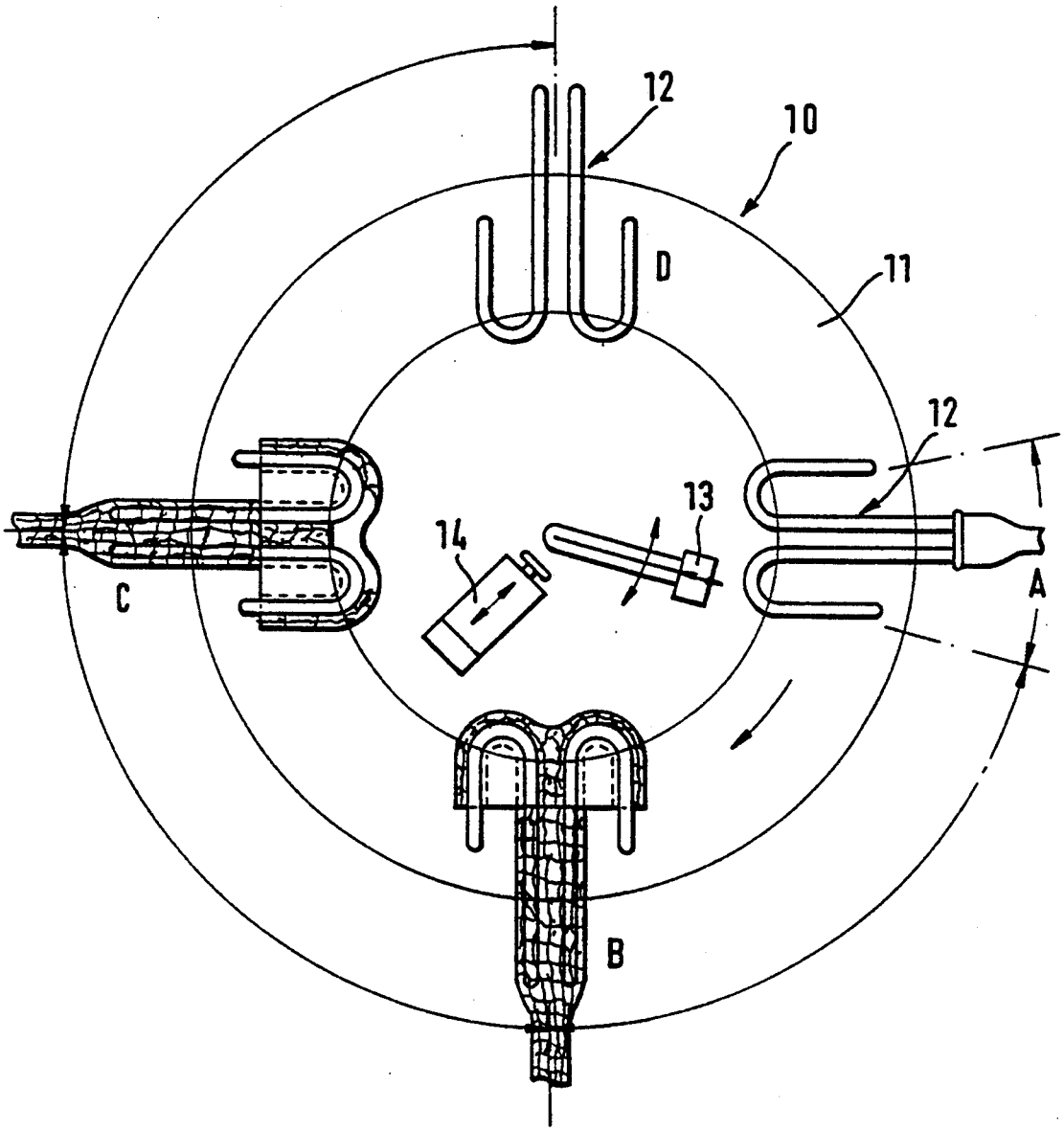
FIG. 1 is a schematic plan view of an arrangement for producing a pantyhose from individual pantyhose parts.

FIG. 1 schematically shows on a plan view a part of an arrangement 10 for producing pantyhoses, and in particular a ring-shaped rotary table 11 with several templates 12 which are arranged on the rotary table and uniformly distributed over its periphery, which are movable in different working stations. A cutting device 13 is locally movable together with the templates, and a radially displacing sewing device 14 is also provided. Four successive operational positions A, B, C and D of the templates 12 are shown.

Figure 2:
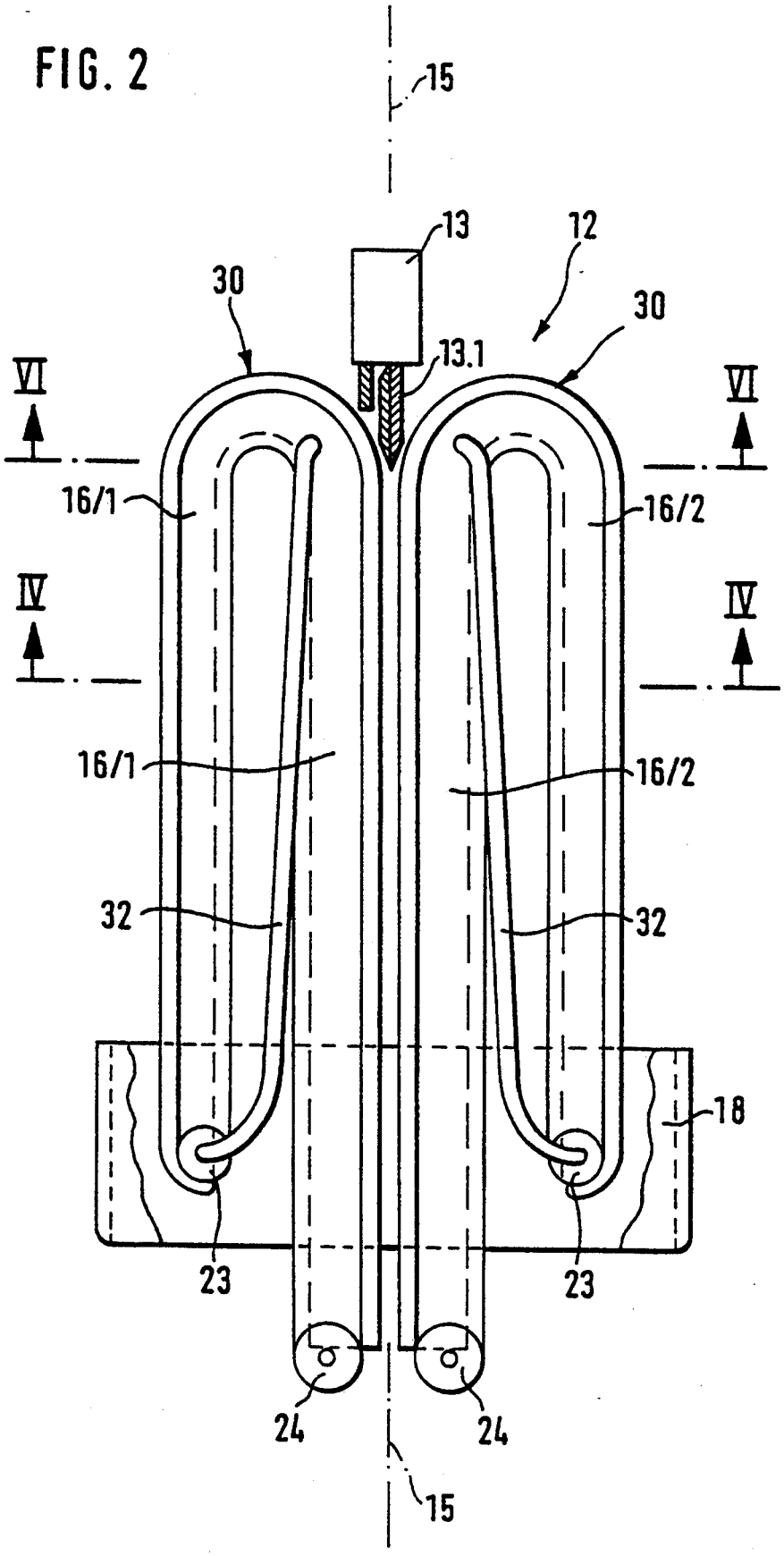
FIG. 2 is a schematic plan view of a template for pulling the pantyhose parts and a cutting device in a cutting position.
Figure 3:
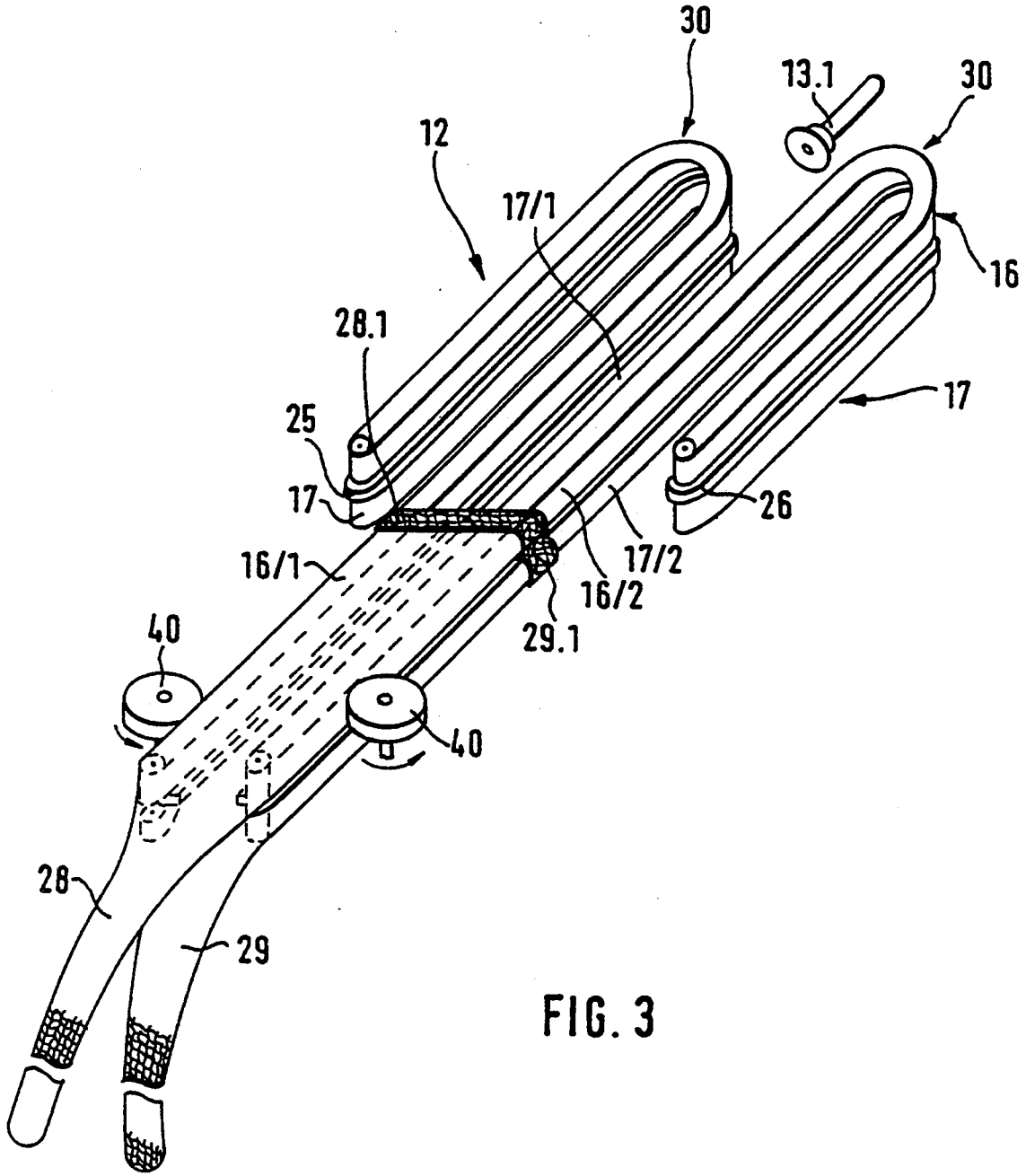
FIG. 3 is a schematic perspective view of the template of FIG. 2 with pantyhose parts pulled to an orientation position.

One template 12 is shown on a plan view and perspective view practically in its working position A in FIGS. 2 and 3. In this position the cutting device 13 with a rotatable cutter 13.1 is located in its working position in a cutting plane 15 which corresponds to a plane of symmetry of the template 12.

Figure 9:
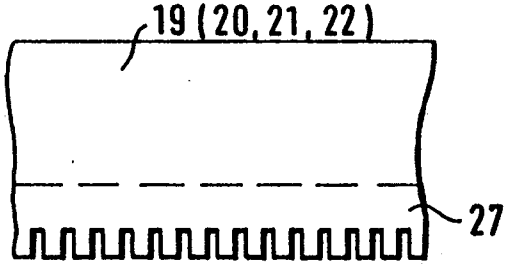
FIG. 9 is a partial side view of a transporting band of the template.
Figure 4:
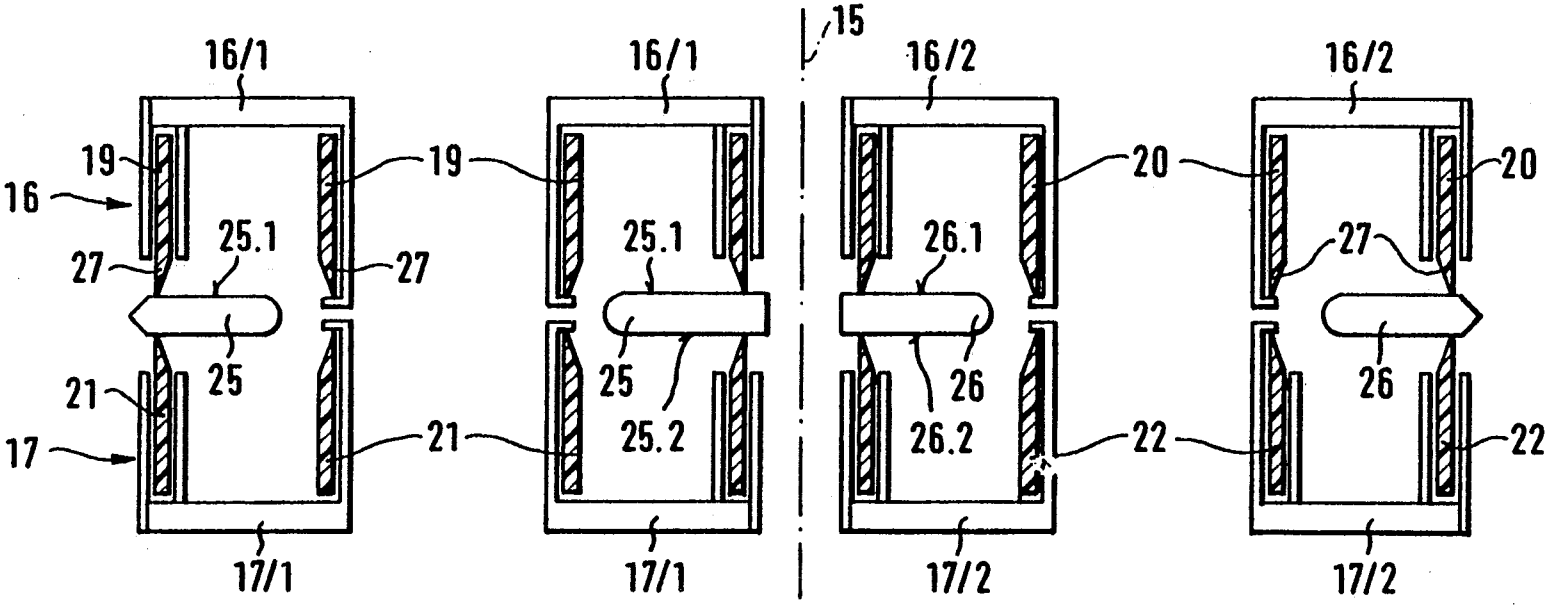
FIG. 4 is a schematic cross-section through supporting arms which form the template, taken along the line IV—IV in FIG. 2, on an enlarged scale.

As can be seen from FIGS. 2, 3 and the enlarged cross-sectional view of FIG. 4, the template 12 has two tensioning frames 16 and 17 which extend parallel to one another. The tensioning frames are identical and are each composed of two mirror-symmetrical U-shaped supporting arms 16/1, 16/2, and 17/1, 17/2 which are symmetrical to the cutting plane 15. The supporting arms of both tensioning frames are held in the region of a partially shown common support 18 and an endless transporting belt 19, 20, 21, 22 is arranged on the corresponding supporting arm 16/1, 16/2, 17/1, 17/2. Each transporting belt is, supported and guided on the end of the outer leg of the transporting arm over a drive roller 23 and at an inner end of the inner leg of the supporting arm over a deviating roller 24. Between these points the drive belts of FIG. 4 run in grooves or paths which are formed on or between wall parts of the supporting arms 16/1, 17/1, 16/2, or 17/2. Sliding webs 25 and 26 are arranged between both tensioning frames 16 and 17 in a parallel plane and run in a U-shaped fashion. The sliding webs 25 and 26 form correspondingly upper sliding surfaces 25.1 or 26.1 and lower sliding surfaces 25.2 and 26.2 In the region of the webs 25 and 26, the transporting belts 19–22 are freely located with a driver edge formed as a driver lip 27. The driver edge is toothed as shown in FIG. 9. The sliding webs 25 and 26 slide with the driver edge on the sliding surfaces 25.1, 15.2, 26.1 and 26.2.

Figure 7:
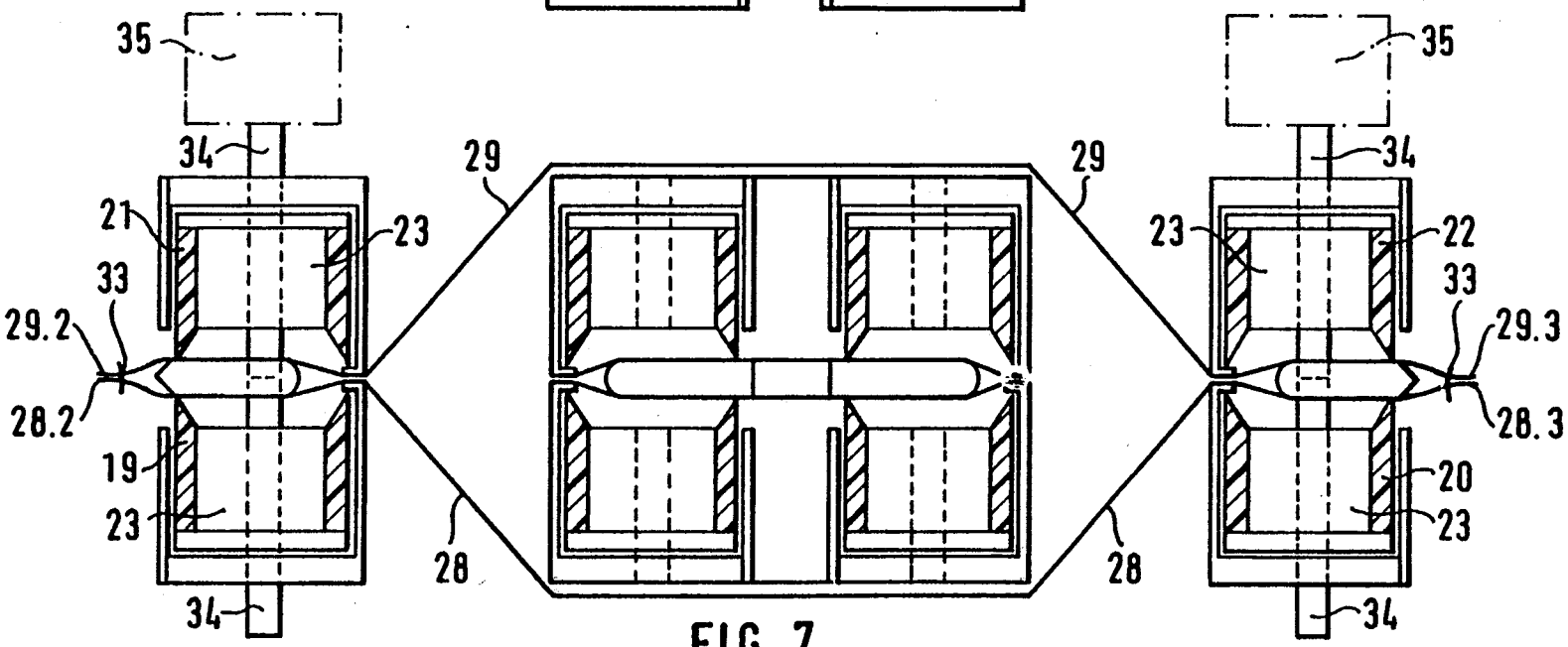
FIG. 7 is a schematic cross-section through the template taken along the line VII—VII in FIG. 5.

In the working station A shown in FIG. 1, a first prefabricated hose-shaped pantyhose part 28 (on the upper tensioning frame 16) and a second pantyhose part 29 (on the lower tensioning frame 17) are placed on the supporting arms of both tensioning frames 16 and 17 on the supporting arm ends which support the deviating rollers 24 (FIG. 2) and pulled to the orientation position shown in FIG. 3. In order to facilitate the pulling, pulling rollers 40 can be driven synchronously with the transporting belts. Two pulling rollers are shown in FIG. 3, and the pulling rollers act on wall parts of the supporting arms 16/1, 16/2, 17/1, 17/2 which serve as sliding surfaces. When subsequently the cutting device 13 with the cutter 13.1 is brought to the operating positions shown in FIGS. 2 and 3, in the cutting plane 15 between the curvature regions 30 of the supporting arms and to the height of the sliding webs 25, 26, then during the displacement path of the template 12 from the working position A to the working position B, the transporting bands together with the supporting arms are driven synchronously. Thereby both pantyhose parts, engaged by the driver lips 27 of the transporting belts 19–22 and held against the sliding surfaces of the sliding webs 25, 26, pass over the cutter 13.1 so that the both pantyhose parts 28 and 29 are separated at the location shown in FIG. 7. The thusly formed both cutting edges 28.2, 28.3 and 29.2, 29.3 of both pantyhose parts 28 and 29 are then guided by the transporting bands on both sliding webs 25 and 26 over the U-curvature region 30 of the transporting arms outwardly. The edges freely extend over a width region 31, which provides a subsequent connection of the edges 28.2, 29.2 and 28.3, 29.3 with one another by sewing up. The uncut parts of the pantyhose parts 28 and 29 which lie correspondingly on the upper side and the lower side of the template 12, are lifted in the region of the curvature 30 by a lifting bars 32 from the supporting arms. The lifting bars extend in FIG. 2 from the support 18 to the U-curvature region 30 of the supporting arms. The release of the formed cutting edges is facilitated and guaranteed by the lifting bars 32 so that the uncut region of the pantyhose parts is not hindered when the cutting edges after passing the U-curvature run practically in opposite direction.

Figure 5:
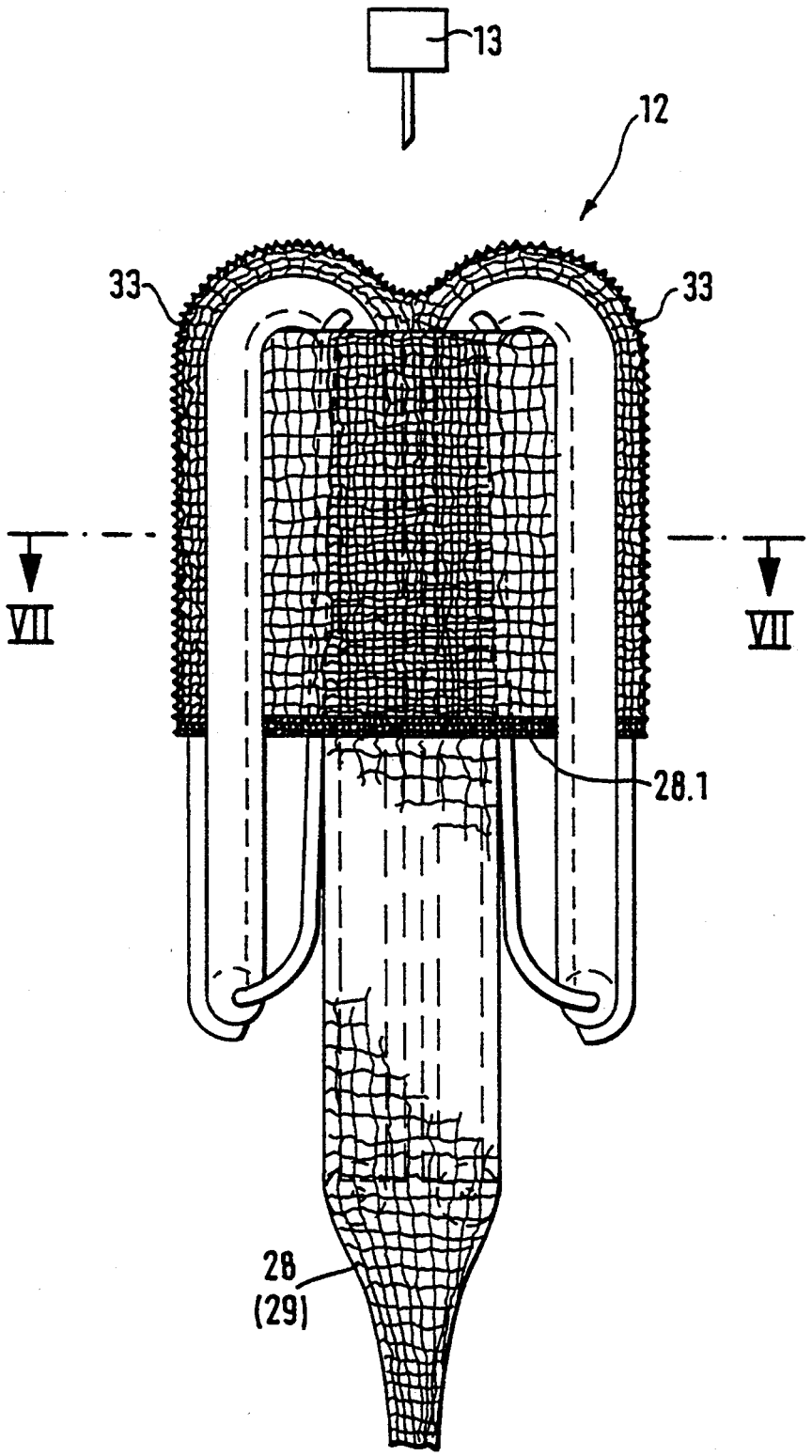
FIG. 5 is a plan view substantially corresponding to the view of FIG. 2 of a template with pulled and cut pantyhose parts after sewing up of the cutting edges to form a pantyhose.
Figure 6:
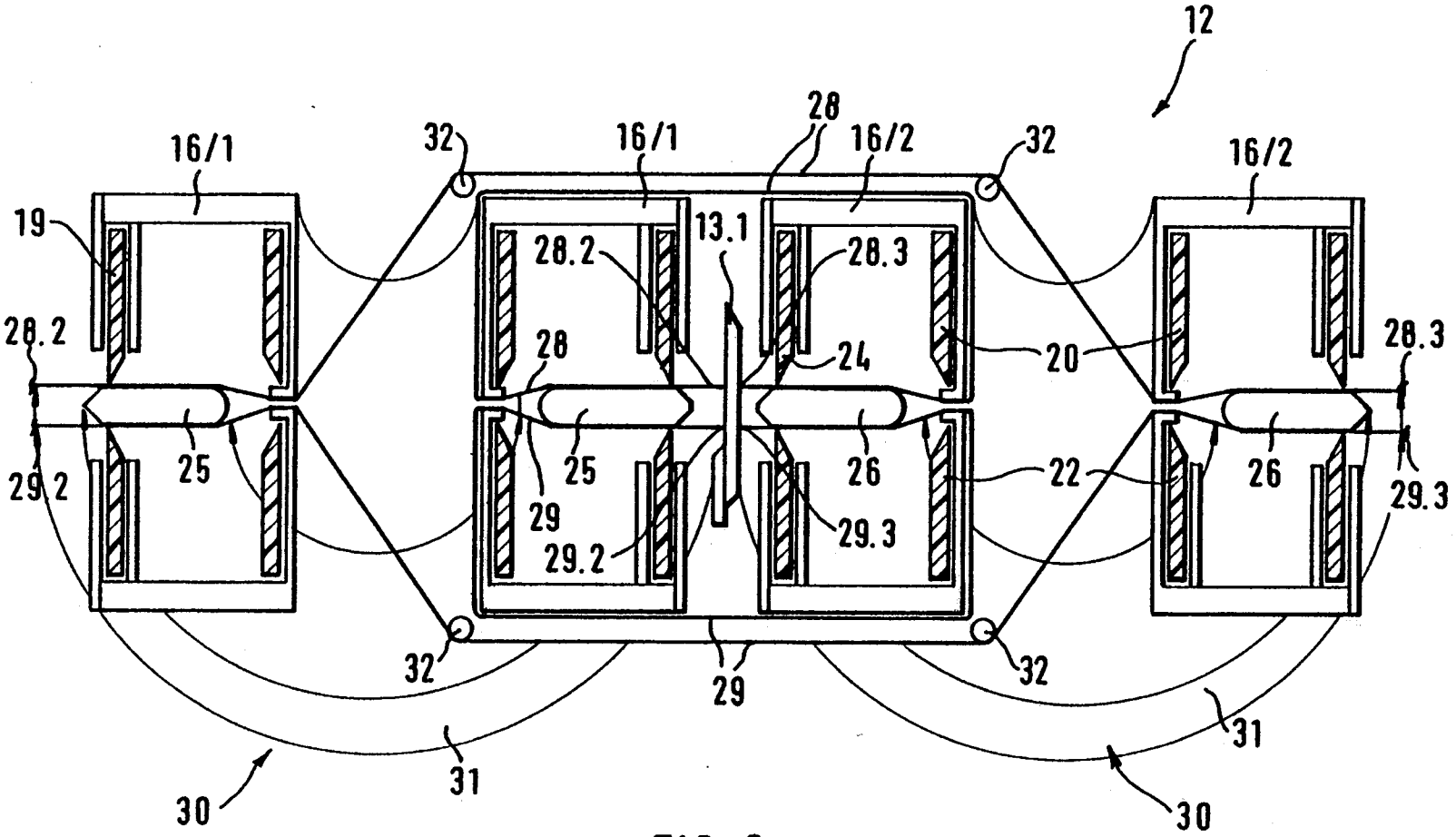
FIG. 6 is a schematic cross-section corresponding to the view of FIG. 4, taken along the line VI—VI in FIG. 2.
Figure 8:
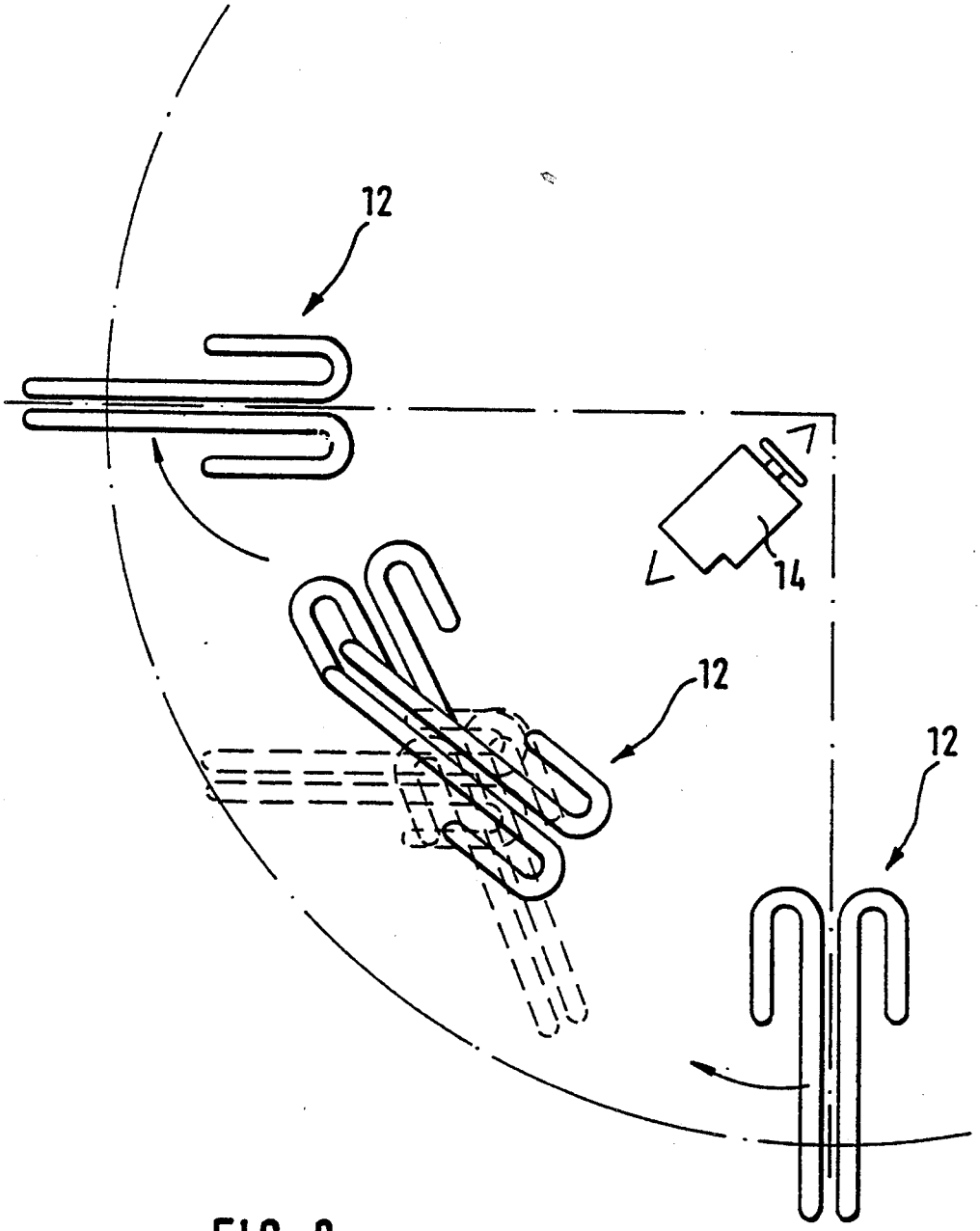
FIG. 8 is a partial plan view with the arrangement of the template in the region of the sewing device.

FIG. 5 shows the both pulled and cut pantyhose parts in their end position and after the formed cutting edges 28.2/29.2 and 28.3/29.3 are already connected by seams 33. This corresponds to the working position C shown in FIG. 1. The seams are formed by the radially adjustable sewing device 14. The template 12 with the pulled and cut pantyhose parts forms a cam-controlled adjusting movement via its support 18 as shown in FIG. 8, until to the sewing device which is moved in the region of the template. The sectional view of FIG. 7 which is turned by 180° relative to FIG. 6 shows partially both pantyhose parts 29 which are connected with one another by the seams 33 to form a pantyhose, in still pulled condition. On this sectional view it also shows the drive shafts 34 of the drive rollers 23 for the transporting band 19, 20, 21 and 22. The drive shafts 34 are drivingly connected with stepper motors 35, of which two stepper motors are identified in broken lines in FIG. 7.

Figure 10:
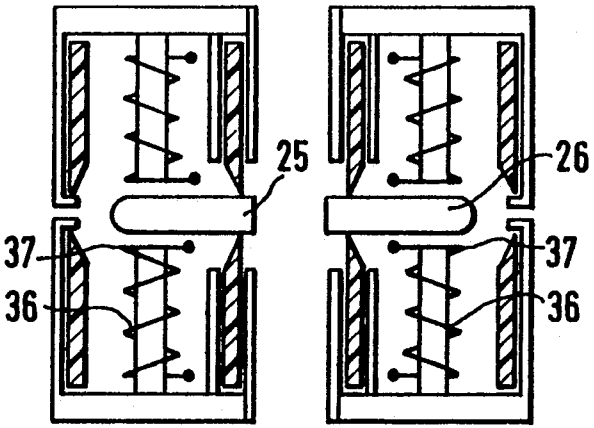
FIG. 10 is a partial transverse view through the supporting arm of the template in the region of the clamping elements.

For thicker products, during pulling the pantyhose parts a braking mechanism can be utilized for increasing the pressure of the transporting belts on the sliding web and preventing an undesirable slippage of the pantyhose parts. For this purpose an electromagnetic braking mechanism 36 is provided in the individual supporting arms. Its armature is coupled with the guiding parts for the transporting belts and ends in a braking plate 37. The braking plate 37 is located opposite to a sliding surface of the sliding webs 25 and 26 with a small distance from them, and a pantyhose part located therebetween is pressed against the sliding web 25 or 26. The braking mechanisms 36 are schematically shown on a sectional view in FIG. 10.

In the working position D shown in FIG. 1, the sewn pantyhose is removed from the template on the path from the working station C to the working station D it is pulled by a reverse synchronous rotary movement of all driving belts of the supporting arms, from the template 12.

It will be understood that each of the elements described above, or two or more together, may also find a useful application in other types of constructions and methods differing from the types described above.

While the invention has been illustrated and described as embodied in an arrangement for and a method of producing a pantyhose, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for producing a pantyhose from prefabricated hose-shaped individual parts, comprising a cutting device defining a cutting plane;

at least one template movable in work stations and having two tensioning frames for pulling corresponding prefabricated pantyhose parts of a pantyhose, said tensioning frames being movable parallel to one another and each being composed of two supporting arms which are mirror-symmetrical relative to said cutting plane of said cutting device, said supporting arms being immovable relative to one another, bent in a plane of said tensioning frames in a U-shaped manner, and supporting driveable endless transporting belts operative for pulling the pantyhose parts on said tensioning frames and for bringing and holding the latter on said tensioning frames in a desired position.

2. An arrangement as defined in claim 1;

and further comprising means for moving said transporting belts and including at least one deviating roller and at least one driving roller for guiding each of said transporting belts, and a stepper motor drivingly connected with said driving roller.

3. An arrangement as defined in claim 2, wherein each of said supporting arms has an outer leg, each of said driving rollers being guided in said outer leg of said supporting arm.

4. An arrangement as defined in claim 1;

and further comprising means for driving said transporting belts and including driving rollers, said tensioning frames of said template having ends located in a region of said driving rollers;

and further comprising a common support which anchors said ends of said tensioning frames with one another.

5. An arrangement as defined in claim 4 and further comprising a stationary sewing device; and a movable table on which said holder is mounted so that said holder is turnable and displacable relative to said stationary sewing device.

6. An arrangement as defined in claim 1, wherein said supporting arms have outer edges, said template being provided with driven rollers which cooperate with said outer edges of said supporting arms and driven in synchronization with said transporting belts.

7. A method for producing a pantyhose from two prefabricated hose-shaped pantyhose parts, comprising the steps of placing one pantyhose part on ends of a supporting arm pair of a first tensioning frame which are close to a cutting plane and pulling point-by-point to a predetermined orientation position by means of transporting belts of said supporting arms;

repeating the preceding step on a second tensioning frame and pulling a second pantyhose part with orientation of an initial portion of the pantyhose part of the second pantyhose part with an initial portion of said first mentioned pantyhose part;

moving one of a template and a cutting device until the cutting device is located in a cutting plane between curves of the four supporting arms;

transporting both pantyhose parts by synchronous driving of all transporting belts through a region of the cutting device with separation of the both pantyhose part hoses at opposite locations of both tensioning frames, and simultaneously lifting both pantyhose parts in their uncut region by lifting bars at opposite sides of both tensioning frames;

moving formed cutting edges by the transporting belts over the curvature in outer legs of the supporting arms over a desired length;

paired sewing of freely located cutting edges which are wound during bending in both pantyhose parts in at least one sewing station;

back transporting the sewn pantyhose parts of the pantyhose from outer legs of the supporting arms by a direction reverse of a transporting belt drive and removing the finished pantyhose from the template.

8. An arrangement for producing a pantyhose from prefabricated hose-shaped individual parts, comprising a cutting device defining a cutting plane;

at least one template moveable in working stations and having two tensioning frames for pulling corresponding prefabricated pantyhose parts of a pantyhose, said tensioning frame being movable parallel to one another and each being composed of two supporting arms which are mirror-symmetrical relative to said cutting plane of said cutting device, said supporting arms being immovable relative to one another, bent in a plane of said tensioning frames in a U-shaped manner, and supporting drivable endless transporting belts, said supporting arms having guiding paths;

and means forming sliding surfaces located between said tensioning frames and extending parallel to said tensioning frames of said template, said endless transporting belts extending in said guiding paths of said supporting arms partially outwardly and having a driver edge extending opposite to said sliding surface for free running on said sliding surfaces.

9. An arrangement as defined in claim 8, wherein said driver edges of said transporting belts are provided with a driver lip which narrows outwardly, is toothed and contacts said sliding surfaces.

10. An arrangement for producing a pantyhose from prefabricated hose-shaped individual parts, comprising a cutting device defining a cutting plane;

at least one template moveable in working stations and having two tensioning frames for pulling corresponding prefabricated pantyhose parts of a pantyhose, said tensioning frames being movable parallel to one another and each being composed of two supporting arms which are mirror-symmetrical relative to said cutting plane of said cutting device, said supporting arms being immovable relative to one another, bent in a plane of said tensioning frames in a U-shaped manner, and supporting drivable endless transporting belts, each of said supporting arms having an outer free end and a curved part, each of said supporting arms having at least one lifting bar which extends from said outer free end and to the region of said curved part.

11. An arrangement for producing a pantyhose from prefabricated hose-shaped individual parts, comprising a cutting device defining a cutting plane;

at least one template moveable in working stations and having two tensioning frames for pulling corresponding prefabricated pantyhose parts of a pantyhose, said tensioning frames being movable parallel to one another and each being composed of two supporting arms which are mirror-symmetrical relative to said cutting plane of said cutting device, said supporting arms being immovable relative to one another, bent in a plane of said tensioning frames in a U-shaped manner, and supporting drivable endless transporting belts having guides;

means forming sliding surfaces, said supporting arms having an electromagnetically actuated braking mechanism which is coupled with said guides of said transporting belts and has a braking plate cooperating with a respective one of said sliding surfaces.

* * * * *